United States Patent [19]

Goetemann et al.

[11] 4,251,588

[45] Feb. 17, 1981

[54] HOLLOW MONOFILAMENTS IN PAPER-MAKING BELTS

[75] Inventors: Gerald B. Goetemann; Robert L. Rackley, both of Parkersburg, W. Va.

[73] Assignee: E. I. Du Pont de Nemours and Company, Wilmington, Del.

[21] Appl. No.: 106,400

[22] Filed: Dec. 26, 1979

[51] Int. Cl.[3] ..... B32B 7/00

[52] U.S. Cl. ..... 428/224; 139/383 A; 139/420 R; 139/425 A; 162/DIG. 1; 162/348; 428/229; 428/257; 428/258; 428/398

[58] Field of Search ..... 139/383 A, 420 R, 425 A; 162/348, DIG. 1; 428/257, 258, 398, 225, 229, 224

[56] References Cited

U.S. PATENT DOCUMENTS

| | | | |
|---|---|---|---|
| 2,132,252 | 10/1938 | Weber | 139/425 A |
| 2,288,512 | 6/1942 | Buchanan | 139/425 A |
| 2,594,693 | 4/1952 | Smith | 428/258 |
| 3,393,210 | 7/1968 | Spich | 260/37 N |
| 3,915,202 | 10/1975 | Curtis et al. | 162/348 |

*Primary Examiner*—James J. Bell

[57] ABSTRACT

Paper-making belts of hollow monofilaments of polyester, polyamide, or polycarbonamide.

8 Claims, No Drawings

HOLLOW MONOFILAMENTS IN PAPER-MAKING BELTS

BACKGROUND OF THE INVENTION

In the preparation of paper, woven support belts are used for the initial casting and subsequent treatment of the paper. These belts are known as paper clothing. A variety of materials has been used in the manufacture of such belts, including metals and, more recently, thermoplastic monofilaments. Thermoplastic materials which have been used in the weaving of these belts include nylon as well as polyester monofilaments.

A continuing problem in the preparation of paper-making belts is providing a belt having an acceptable balance of dimensional stability and flexibility. A variety of techniques has been proposed, including the use of thermoplastic monofilaments having different degrees of orientation in the machine and transverse directions, as described in Curtis et al. U.S. Pat. No. 3,915,202. However, previously proposed techniques have often failed to provide the desired balance between dimensional stability and flexibility, or resulted in a woven belt which became brittle after a relatively short period of service.

SUMMARY OF THE INVENTION the present invention provides paper-making belts having excellent dimensional stability and improved flex life.

Specifically, the instant invention provides, in a woven, heat set, paper-making belt of machine and transverse direction thermoplastic filaments, the improvement wherein the filaments in at least one of the machine and transverse directions are hollow monofilaments of polyester, polyamide or polycarbonamide, having a diameter of about from 6–32 mils (0.15–0.81 mm), oriented about from 3.4 to 6.0 times their original length, and having a void content of about from 3–15 percent of their cross-sectional area.

DETAILED DESCRIPTION OF THE INVENTION

The hollow monofilaments used in the present invention can be prepared from a variety of thermoplastic polymeric materials. Polyesters which can be used include polyethylene terephthalate. Polyamides which can be used include nylon 66, nylon 610 and nylon 612, of which nylon 66 is preferred because of superior high temperature performance. Particularly preferred in the instant invention are polycarbonamides of the type described in detail in Speck, U.S. Pat. No. 3,393,210, hereby incorporated by reference. These polycarbonamides are preferred because of the combination of outstanding characteristics, including a resistance to moisture absorption as well as a resistance to hydrolysis which contributes to exceptionally long belt life.

the filaments used in the preparation of the present paper-making belts are prepared according to customary techniques for making hollow monofilaments. The molten thermoplastic polymer is extruded through a vented orifice die into a quench medium, after which it is oriented. The monofilaments used in the present invention should be oriented from about from 3.4 to 6.0 times their original length, and preferably about from 3.5 to 4.75 times their original length. The monofilaments generally have a diameter of about from 6 to 32 mils (0.15–0.81 mm).

The hollow monofilaments should have a void content of about from 3 to 15 percent of their cross-sectional area. With a void content of less than about 3%, little benefit over solid monofilament is realized. With a void content in excess of 15%, the monfilament tends to lose readily its substantially circular cross-sectional configuration and flattens to a substantially void-free filament.

The hollow monofilaments are woven into paper-making belts according to conventional weaving techniques. The type and density of the weave, will, of course, depend on the type of paper and paper-making operation for which the belt is to be used. After weaving, the belts are heat set according to conventional techniques to stabilize the weave. Typical heat setting conditions will vary with the polymer, filament diameter and weave, but will typically involve heating under tension in a hot air oven for about from 15 minutes to 1 hour at a temperature of about from 300° to 400° F.

The paper-making belts of the present invention, prepared from hollow monofilaments, exhibit excellent dimensional stability and performance characteristics. Particularly with those monofilaments prepared from polycarbonamides, a more uniform woven material can be obtained with a greater degree of interlocking and rigidity than with solid monofilaments with the same material. The hollow monofilaments result in a weave which is more stable under deforming stresses. The useful life of the belt is therefore prolonged, since the interstices which control moisture uniformity in paper-making operations retain their original dimensions. Moreover, increased flex life of the woven belt is obtained.

The invention is further illustrated by the following specific examples.

Examples 1, 2 and 3 and Comparative Examples A-E

A polymer prepared from dodecanedioic acid and bis(para-aminocyclohexyl)methane was spun into a filament from a vented orifice spinneret and oriented by stretching 4 to 4.75 times its original length. The hollow filaments had a void content of 8% and an outer diameter of 21 mils. In Comparative Examples A-E, a solid monofilament was prepared having a draw ratio of 4.0. In comparative Examples A and B the filament was extruded from the same polymer as in Example 1. In Comparative Example C, the polymer used was nylon 66. In Comparative Examples D and E, the polymer used in Comparative Example A was admixed with about 10 weight percent of a second component. In Comparative Example D the second component was a high density polyethylene having a Melt Index of 12. In Comparative Example E the second component was a graft copolymer of the monoethyl ester of maleic anhydride and a copolymer of ethylene, propylene, and 1,4-hexadiene.

The solid monofilament of Comparative Example A and the hollow monofilaments of Examples 1, 2 and 3 were found to exhibit substantially equivalent physical properties. However, the hollow monofilaments of Examples 1, 2 and 3 exhibited substantially higher flex life than the solid monofilament of Comparative Example A. The results of the testing are summarized in Table I.

TABLE I

| Example | A | 1 | 2 | 3 |
|---|---|---|---|---|
| Draw Ratio | 4.0 | 4.0 | 4.5 | 4.75 |
| MIT Flex* (ave. of 10/minimum) | 252/84 | 579/204 | 458/276 | 333/203 |

*ASTM-D-2176 adapted to filaments

Paper-making screens were woven using warp materials of solid monofilament as prepared in Comparative Examples A, B, D and E with fill (transverse direction) material of Examples 1 and A–E. The resulting woven screens were evaluated for performance during weaving, and the results reported in Table II. Those fabrics having the hollow monofilament of the present invention generally exhibited substantially fewer strand breaks during weaving and provided more filling strands from a given warp tension level then the solid strands. This should permit lower tension weaving and further reduction in break frequency.

TABLE II

| | | | | | NO. OF WARP STRAND BREAKS | | | | | |
|---|---|---|---|---|---|---|---|---|---|---|
| | | | | | Polycarbonamide Warp Material | | | | | |
| Ex. | Yards Woven | Meters Woven | PPI* | P/CM* | | | With Grafted Polymer | With Polyethylene | Diameter of Fill Filaments | |
| A | 6.56 | 6.00 | 15 | 5.9 | 34 (5.18)[5.67] | 16 (2.44)[2.67] | 8 (1.22)[1.33] | 76 (11.59)[12.67] | 21.0 mils | 0.53mm |
| B | 4.19 | 3.83 | 15 | 5.9 | 18 (4.30)[4.70] | 2 (0.48)[0.52] | 7 (1.67)[1.83] | 40 (9.55)[10.44] | 21 | 0.53mm |
| C | 2.44 | 2.23 | 15 | 5.9 | 6 (2.46)[2.69] | 3 (1.23)[1.35] | 4 (1.64)[1.79] | 20 (8.20)[8.97] | 21 | 0.53mm |
| D | 0.50 | 0.46 | 15 | 5.9 | 0 | 0 | 0 | 1 (2.00)[2.17] | 21 | 0.53mm |
| E | 0.50 | 0.46 | 16 | 6.3 | 0 | 0 | 0 | 0 | 19.5 | 0.50mm |
| 1 | 0.25 | 0.23 | 15.5 | 6.1 | 0 | 0 | 0 | 3 | 21 | 0.53mm |

( ) = frequency/yard
[ ] = frequency/meter
*Picks per inch or centimeter

The drier screen woven with fill strands of the material of Example 1, and with a warp of the filament of Comparative Example A, was compared to a drier screen woven entirely of the solid filaments of Comparative Example A. The two woven materials were compared for weave stability. Eight-inch square sections of screen were used for the test. An 800 pound force was applied across the diagonal ends of each screen using an Instron tester. The number of warp strands that peeled away from the fabric was determined, and the results are summarized in Table III.

TABLE III

| | No. Warp Strands "Peeled" From Screen | |
|---|---|---|
| | Solid Fill Strands | Hollow Fill Strands |
| Nonheat-Set Screen | | |
| Test No. 1 | 10 | 10 |
| Heat Set Screen | | |
| Test No. 2 | 5 | 0 |
| Test No. 3 | 25 | 1 |
| Test No. 4 | 5 | 3 |
| Load where "peeling" started | 510 lbs.<br>231 kg. | 730 lbs<br>331 kg. |

The hollow fill strands provide a significantly higher degree of weave stability than the solid monofilaments.

We claim:

1. In a woven, heat set, paper-making belt of machine direction and transverse direction thermoplastic filaments, the improvement wherein the filaments in at least one of the machine and transverse directions are hollow monofilaments of polyester, polyamide or polycarbonamide, having a diameter of about 6 to 32 mils, oriented about 3.4 to 6.0 times their original length, having a void content of about from 3–15 percent of their cross-sectional area.

2. A woven paper-making belt of claim 1 wherein the transverse direction thermoplastic filaments are hollow monofilaments.

3. A woven paper-making belt of claim 1 wherein the machine direction and transverse direction thermoplastic filaments are hollow monofilaments.

4. A woven paper-making belt of claim 1 wherein the hollow monofilaments consist essentially of polycarbonamide.

5. A woven paper-making belt of claim 4 wherein the polycarbonamide consists essentially of a reaction product of dodocane dioic acid and bis(para-aminocyclohexyl)methane.

6. A woven paper-making belt of claim 1 wherein the hollow monofilaments have a void content of 7–8 percent based on the cross-sectional area of the filaments.

7. A woven paper-making belt of claim 1 wherein the hollow monofilaments are oriented about from 3.5 to 4.75 times their original length.

8. A woven paper-making belt of claim 1 wherein the hollow monofilaments consist essentially of polyethylene terephthalate.

* * * * *